US007836545B2

(12) United States Patent
Maier et al.

(10) Patent No.: US 7,836,545 B2
(45) Date of Patent: Nov. 23, 2010

(54) MANUALLY GUIDED SUCTION APPARATUS

(75) Inventors: Georg Maier, Kernen (DE); Wolfgang Layher, Waiblingen (DE); Markus Zwimpfer, Fellbach (DE); Uwe Gaese, Stuttgart (DE); Marco Deuchert, Karlsruhe (DE); Michael Hermann, Eggenstein (DE); Sebastian Gembardt, Weinheim (DE); Jochen Keinath, Karlsruhe (DE); Rolf Erhardt, Karlsruhe (DE)

(73) Assignee: Andreas Stihl AG & Co. KG (DE)

( * ) Notice: Subject to any disclaimer, the term of this patent is extended or adjusted under 35 U.S.C. 154(b) by 1049 days.

(21) Appl. No.: 11/598,184

(22) Filed: Nov. 9, 2006

(65) Prior Publication Data

US 2007/0101534 A1 May 10, 2007

(30) Foreign Application Priority Data

Nov. 10, 2005 (DE) ..... 10 2005 053 632

(51) Int. Cl.
*A47L 5/14* (2006.01)

(52) U.S. Cl. ..... 15/346; 15/330

(58) Field of Classification Search ..... 15/346, 15/347, 327.5, 330, 348, 349, 405, DIG. 8, 15/327.3, 327.7, 331, 353
See application file for complete search history.

(56) References Cited

U.S. PATENT DOCUMENTS

| | | | | |
|---|---|---|---|---|
| 4,559,666 | A * | 12/1985 | Duncan et al. | 15/353 |
| 4,569,100 | A * | 2/1986 | Purkapile | 15/327.2 |
| 5,267,371 | A * | 12/1993 | Soler et al. | 15/327.5 |
| 6,131,239 | A | 10/2000 | White | |
| 6,334,234 | B1 * | 1/2002 | Conrad et al. | 15/347 |
| 6,379,439 | B1 * | 4/2002 | Shimizu | 96/333 |
| 6,524,358 | B2 * | 2/2003 | Yang | 55/337 |
| 6,736,873 | B2 * | 5/2004 | Conrad et al. | 55/459.1 |

FOREIGN PATENT DOCUMENTS

| | | |
|---|---|---|
| CN | 1473541 | 2/2004 |

* cited by examiner

*Primary Examiner*—Dung Van Nguyen
(74) *Attorney, Agent, or Firm*—Robert Becker; Robert Becker & Assoc.

(57) ABSTRACT

A manually guided suction apparatus for suctioning up material via a suction air stream, comprising a suction fan having a fan housing surrounding a fan wheel and provided with an intake opening. A centrifugal separator is disposed upstream of the intake opening and produces a curved path of the suction air stream. The centrifugal separator has a curved peripheral wall in which is disposed a removal opening for material that is to be sucked up. The intake opening is disposed approximately in a central portion of the centrifugal separator.

19 Claims, 12 Drawing Sheets

MANUALLY GUIDED SUCTION APPARATUS

The instant application should be granted the priority date of Nov. 10, 2005 the filing date of the corresponding German patent application 10 2005 053 632.8.

BACKGROUND OF THE INVENTION

The present invention relates to a manually guided suction apparatus for suctioning up material via a suction air stream.

Manually guided suction apparatus are used in particular as devices in parks and gardens that can be carried on the back for suctioning up material in the form of dirt, refuse, leaves, or the like. Another application is the collection of small fruits, such as nuts, olives or the like.

A suction fan that is driven by a drive motor draws in an air stream and blows it back out as a discharge air stream. In a known construction, a venturi device is disposed in the discharge air stream for producing an underpressure therein, thereby generating a suction air stream for sucking up the material. In another known construction, the air stream that is drawn in by the suction fan is used as a suction air stream for sucking up material. Particles carried along by the suction air stream can pass into the interior of the suction fan and lead to wear or damage of the fan wheel and of the fan housing.

In both cases, it is desired for a good handling of the suction apparatus to achieve a high suction capacity at low apparatus weight and at a small overall size of the suction apparatus, and to bring about an effective removal of the sucked-up material out of the air stream.

It is therefore an object of the present invention to improve a manually guided suction apparatus of the aforementioned general type in such a way that an improved suction capacity in combination with a good removal effect is achieved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
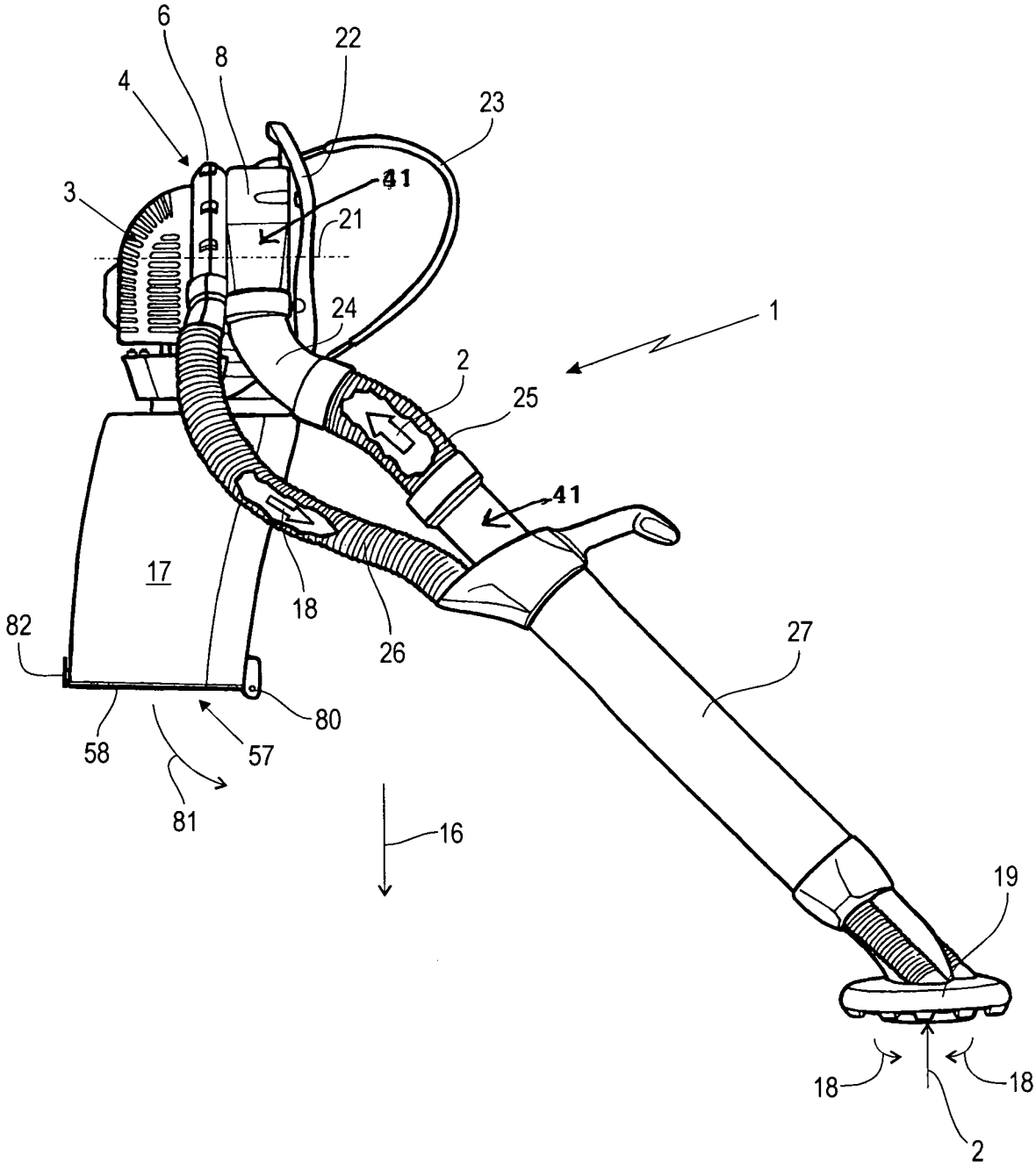
FIG. 1 is a side view of an inventive suction apparatus that can be carried on the back and that has a radial fan and upstream thereof a centrifugal separator.

The manually guided suction apparatus of the present application for suctioning up material via a suction air stream comprises a suction fan that is driven by a drive motor and includes a fan wheel and a fan housing that surrounds the fan wheel; the fan housing has an intake opening, and a centrifugal separator is disposed upstream of the intake opening for producing a curved path of the suction air stream; the centrifugal separator has a curved peripheral wall in which is disposed a removal opening for material that is to be sucked up; the intake opening is disposed approximately in a central portion of the centrifugal separator. As a result of the curved path of the suction air stream, the relatively heavy, coarse material that is to be sucked up, due to its mass moment of inertia or the centrifugal forces that occur, is urged outwardly toward the curved peripheral wall, where it slides along. As the sucked-up material slides along the peripheral wall, it meets the removal opening that is disposed in the curved peripheral wall and exits outwardly though this opening, for example into a collection container. After passing the removal opening, the suction air stream has only a low particle concentration. Residual particles that remain are also concentrated toward the outside due to the centrifugal force, while the center of the centrifugal separator has only a relatively low particle concentration. The intake opening of the suction fan is disposed in the central portion through which the suction air stream now enters with a significantly lower particle loading. The fan wheel and the fan housing are thus subjected to only slight abrasion, while at the same time a high suction capacity is ensured. The danger of damage or clogging is reduced.

Pursuant to a preferred further development, the peripheral wall of the centrifugal separator has a path that narrows in a spiral manner in the direction of flow of the suction air stream. It has been surprisingly shown that this path that narrows in a spiral manner causes an increase of the air throughput and of the removal effect. The material that is sucked up is nearly entirely removed from the suction air stream through the removal opening. Any residual concentration that remains in the suction air stream is more effectively kept away from the central removal opening.

An inlet opening of the centrifugal separator can be centrally or peripherally disposed in an end wall of the separator, and is preferably provided in the region of the peripheral wall; in this connection, it empties in particular tangentially into the centrifugal separator. Immediately after entry into the inlet opening, the suction air stream undergoes a deflection along the curved path, so that the centrifugal forces act upon the sucked-up material over the entire path. Already after a short length of the path, the desired high concentration of the sucked-up material is placed against the inner side of the peripheral wall. Only a short amount of the path is necessary to achieve the desired removal effect, thus contributing to a compact construction of the suction apparatus.

It can be expedient to dispose the inlet opening and the removal opening in planes that are offset from one another, whereby the suction air stream follows a helical path in the separator housing. The inlet opening and the removal opening are expediently disposed in a common plane that is transverse to the curved peripheral wall. The peripheral wall in particular extends between the inlet opening and the removal opening, in the direction of flow of the suction air stream, about a peripheral angle of from 180 to 270°. A flat, compact manner of construction results for the centrifugal separator, along with a high efficiency.

To increase the removal efficiency, in the customary operating position the removal opening faces downwardly as viewed in a gravitational direction. Added to the centrifugal forces acting upon the sucked-up material, in the region of the removal opening, is the force of gravity, which enhances a complete discharge of the sucked-up material out of the removal opening.

Pursuant to an expedient embodiment, the suction fan is a radial fan, whereby the radial fan and the centrifugal separator have parallel axes, and in particular are disposed coaxially relative to one another. The central intake opening of the radial fan can empty directly into the central portion of the centrifugal separator without the interposition of hose lines or the like. A compact manner of construction results with little flow loss.

Pursuant to a preferred further development, the direction of flow of the suction air stream in the centrifugal separator is opposite to a direction of rotation of the fan wheel. It has been surprisingly shown that such opposite directions increase the air throughput through the separator and the fan, and hence improve the suction capacity.

A discharge opening of the radial fan can in particular be disposed approximately in alignment with the inlet opening of the centrifugal separator. The discharge and the connection of a suction hose are disposed on the same side of the apparatus in the immediate vicinity of one another, which improves the ergonomics of the suction apparatus, especially where the apparatus is designed to be carried on the back. The connection of a suction nozzle having an intergrated air discharged is simplified.

The intake opening of the suction fan is preferably provided with an inlet protector that in particular extends over the intake opening. The inlet protector preferably extends into the inner chamber of the centrifugal separator and is expendietly connected to the fan wheel in such a way as to rotate therewith. A residual concentration of particles that remains in the suction air stream impinges against the inlet protector and is flung outwardly. The inlet protector provides a reliable protection against the entry of foreign bodies into the intake opening of the suction fan. It is possible to mount the inlet protector directly on the fan wheel; accordingly, it is not necessary for the inlet protector, which rotates along with the fan wheel, to have its own grounding support.

The inlet protector can expediently be embodied as a grate, in particular having a hemispherical configuration. A small construction results having a high repelling effect due to the shape. The spherical shape leads to a high component rigidity in conjunction with a large free intake cross-section, which contributes to the increase of the air throughput. Alternatively, it can be expedient for the inlet protector to have radially extending impact paddles that in particular in an inner chamber of the centrifugal separator extend over an edge region of an end wall of the fan housing that includes the intake opening. Particles that are carried along in the air stream impinge against the impact paddles and are flung outwardly. The edge region of the end wall that adjoins the intake opening is cleared or cleaned by the impact paddles. No deposits can form here.

Pursuant to an expedient embodiment, the suction air stream is guided past the removal opening, whereby the removal opening empties into an essentially flow-tight collection device. No air stream that flows through is formed in the collection device itself. The introduction of the sucked-up material is effected alone due to its weight or the centrifugal forces, without a partial stream of the suction air stream having to be branched off through the collection device. Rather, the suction air stream extends nearly entirely, and free of loss, through the suction fan. The suction capacity is increased.

It can be expedient to provide as the collection device an essentially rigid collection container into which the removal opening empties. The collection container is not sensitive to sharp-edged material that is sucked up, such as metal cans or the like. Not sensitive to fluctuations in pressure or the like, the collection container maintains its receiving volume, even under varying atmospheric or suction conditions.

Alternatively, or in addition thereto, it can be advantageous for the collection device to include a collection bag that is closed off in an essentially flow-tight manner, whereby an endless tube is provided that is folded up to form a supply portion that is stored in a storage chamber of the suction apparatus, and which proceeding from the storage chamber has container portion that forms the collection bag.

It has been shown that with an appropriate configuration of the removal opening in the intake channel, a removal of the sucked-up material from the suction air stream can be effected without having to guide the suction air stream itself into the collection bag or through it. By utilizing the force of gravity and/or the centrifugal force where a curved path is provided for the suction air stream, a separation can essentially be produced using only the inertial forces that occur. The lack of a noticeable air stream in the collection bag makes it possible to close off the bag in an essentially flow-tight manner without having to provide a complicated shaped support for the expansion of the collection bag. Depending upon the configuration of the suction apparatus, an inner pressure can be obtained in the collection bag that, although it deviates from the atmospheric pressure, does not produce a significant pressure differential. By using simple shape-imparting means, or merely by means of the sucked-up material that enters, the collection bag maintains is volumetric shape with a large receiving capacity.

Providing an endless tube for forming the collection bag improves operator comfort. When the collection bag is sealed, the container portion that forms the collection bag can be removed from the endless tube and can be closed off. The supply portion of the endless tube that is made available in the storage chamber is then withdrawn, whereby after being closed off at the bottom it forms the new collection bag. In particular, the possibility is provided that after filling the collection bag the endless tube can be bound off or clamped shut above the filled quantity, and can subsequently then be removed. The operator does not come into contact with the filled material, thereby avoiding hygiene problems.

The storage of the endless tube in the storage chamber permits operation that is nearly free of interruption. A complicated and cumbersome emptying of the collection bag is not required. Rather, a sufficient length of hose is kept available in the storage chamber that suffices to form a plurality of collection bags. After the collection bag is filled it can be removed and placed to the side without the necessity for a cumbersome emptying and/or insertion of an empty collection bag.

Pursuant to an advantageous further development, a weight support of the collection bag can be provided to prevent a pulling of the supply portion out of the storage chamber. The weight support of the collection bag prevents an automatic pulling of the supply portion out of the storage chamber under the effect of the weight of the filled material. The collection bag can be disposed in a freely suspended manner on a suitable holder, as a result of which an overall straightforward structural design is provided. Shape imparting and supporting containers, which adversely affect the ability to handle the suction apparatus and limit the filling capacity, are not required. Rather, the receiving volume of the collection bag can be arbitrarily set by the user by withdrawing a freely selectable length of the endless tube and closing it off to form a collection bag. With lightweight material that is to be sucked up, such as, for example, leaves, the bag can be correspondingly large, whereas with heavy material the collection volume can be set correspondingly small by the operator.

A shape-imparting support structure is preferably provided for the collection bag and is disposed in particular on the inside of the collection bag. The receiving volume of the collection bag that is prescribed by the quantity of tube that is withdrawn can be utilized to the maximum extent. The sucked-in or filled material that enters as a result of its weight need not actively expand the collection bag; rather, the material can, in an unobstructed manner, enter into the interior of the collection bag that has been previously expanded by the shape-imparting support structure.

Pursuant to a preferred embodiment, a discharge air stream that is produced by the suction fan is conveyed to a suction nozzle that guides the suction air stream. The discharge air stream whirls the material that is to be sucked up and that is carried along by the suction air stream and that is conveyed into the collection container. The suction air stream and the discharge air stream form an at least nearly closed system in which the air stream circulates without any great flow losses. A high suction capacity is provided with a low engine power and a compact construction.

Further specific features of the present application will be described in detail subsequently.

DESCRIPTION OF SPECIFIC EMBODIMENTS

Referring now to the drawings in detail, FIG. 1 shows a side view of a manually-guided or portable suction apparatus 1 that is designed for being carried on the back of an operator and serves for suctioning up material by means of a suction air stream 2. The suction apparatus 1 includes a drive motor 3, which is not illustrated in detail, is disposed in a housing, and drives a suction fan 4. In the illustrated embodiment, the drive motor is an internal combustion engine, but could also be an electric motor or the like. The suction fan 4 is embodied as a radial fan that is provided with a horizontal axis of rotation 21. An axial fan could also be expedient. Disposed between the suction fan 4 and a backpack 22 having a carrying strap 23 is a centrifugal separator 8, an end face of which is flanged onto that side of a fan housing 6 of the suction fan 4 that is disposed opposite the drive motor 3.

During operation, a suction nozzle 19, which is secured to a free end of a guide tube 27, is held against a surface that is to be cleaned. The suction fan 4 draws in a suction air stream, which is illustrated by the arrows 2; the suction air stream enters the suction nozzle 19 and in so doing carries along the material that is to be suctioned up from the ground. The suction air stream 2 is introduced via the guide tube 27, the suction air hose 25, and an elbow 24 into the centrifugal separator 8, from where it is conveyed into the suction fan 4. The guide tube 27, the suction air hose 25, the elbow 24, and the centrifugal separator 8 form a suction or intake channel 41, which conveys the suction air stream 2 from the suction nozzle 19 to the suction fan 4. On the outlet side, the suction fan 4 generates a discharge air stream, i.e. a blowing air stream, which is indicated by the arrows 18 and can empty into the atmosphere; in the illustrated embodiment, the discharged air stream is conveyed through a discharge or blowing air hose 26. Both the suction air hose 25 and the discharge air hose 26 are connected to the guide tube 27, at the opposite free end of which is disposed the suction nozzle 19. The discharge air stream 18 that is generated by the suction fan 4 is discharged at the suction nozzle 19, where it whirls the material that is to be sucked up and, mixed with secondary air, again enters the suction nozzle 19 as the suction air stream 2. An essentially closed air stream system results, whereby flow losses are limited to the region of the suction nozzle 19 and the withdrawal of the non-illustrated cooling air stream for the drive motor 3.

The suction apparatus 1 is shown in the normal operating position relative to a downwardly directed gravitational direction, which is indicated by the arrow 16. Relative to the gravitational direction 16, an essentially flow-tight collection device is disposed below the centrifugal separator 8, and is secured thereto in a sealing manner. The collection device can be embodied in conformity with the illustration of FIGS. 7 to 12, and in the illustrated embodiment is a collection container 17 in which the material sucked up by the suction nozzle 19 is separated out of the air stream 2 and is conveyed into the collection container 17. The material sucked up can be dust, dirt, leaves, material that has been mowed, etc. Small fruits such as nuts, olives or the like can also be sucked up.

The collection container 17 is essentially rigid. This means that under normal operating load, with pressure differences acting between the outside and the inside, and also under the weights of the filled or sucked-up material, the container essentially maintains its shape, and in particular its prescribed filling volume. Disposed on the underside 57 of the collection container 17 is a detachable bottom 58 that in the illustrated closed position closes the collection container off in an air tight and liquid tight manner. On the side of the backpack 22, the bottom 58 is pivotably secured to the rear wall of the collection container 17 by means of a joint or articulation 80. Provided on the opposite side is a closure means 82 that holds the pivotable bottom 58 in a closed position. After the closure means 82 is opened, the bottom 58 can be pivoted downwardly in the direction of the arrow 81 about the joint 80 as a pivot axis. The sucked-up material collected in the container 17 can be emptied. The closure means 82 is preferably a snap-type closure that can be manually released. It can also be expedient to provide an actuation cable, a Bowden cable, or the like, by means of which the closure means 82 can be opened by the user while carrying the suction apparatus 1 on his or her back.

Figure 6:
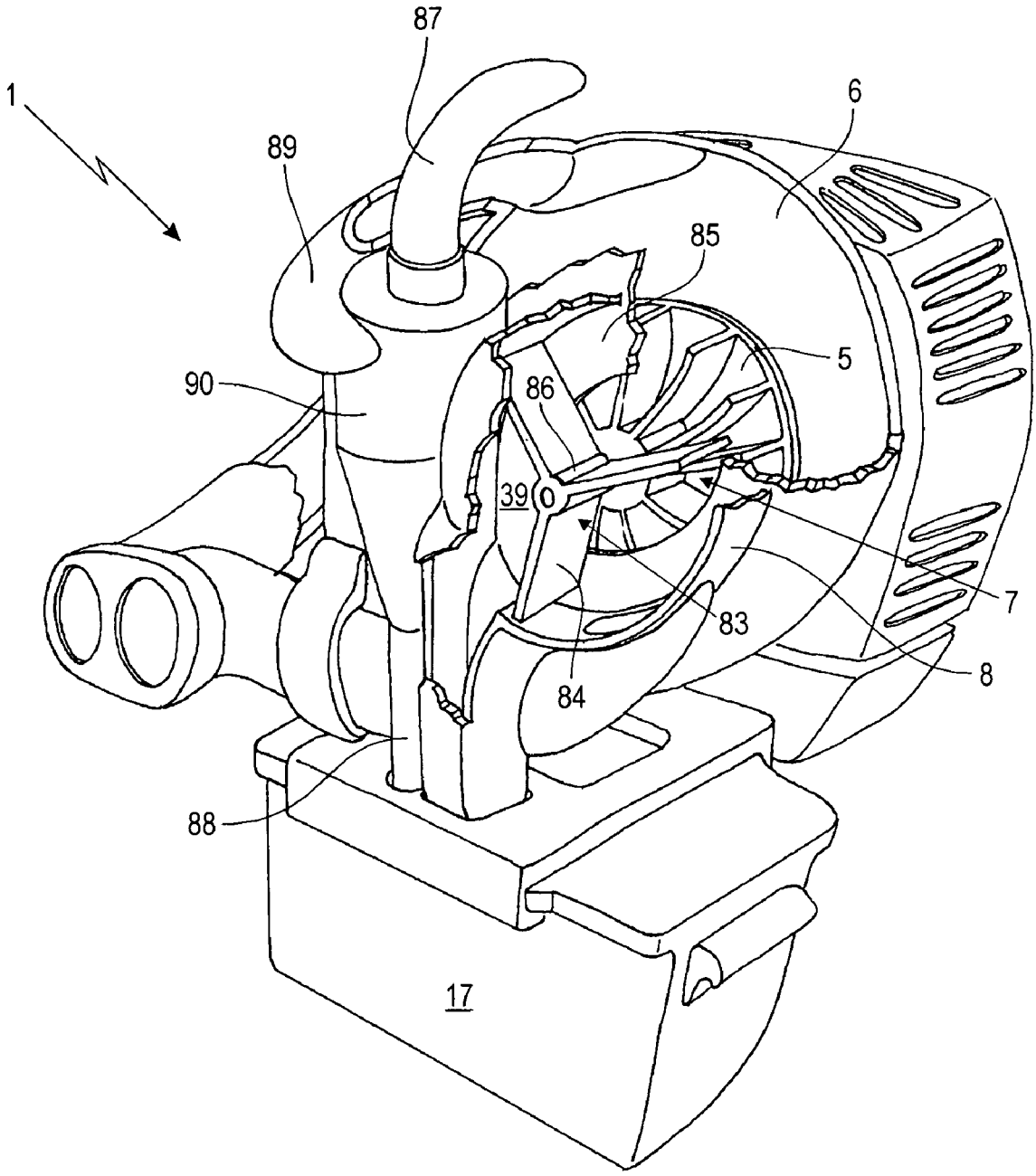
FIG. 6 is a perspective, partially cross-sectioned view of an embodiment having an inlet protector that is provided with impact paddles.

In addition to the centrifugal separator 8, in which a coarse separation of the sucked-up material from the suction air stream 2 is effected, a fine separator, for example in the form of a cyclone 90, as is illustrated in FIG. 6, could also be provided. Such a fine separator can, for example, be provided between the centrifugal separator 8 and the suction fan 4, and in particular downstream of the suction fan, whereby the dust or other material that is separated out is preferably conveyed into the collection container 17.

Figure 2:
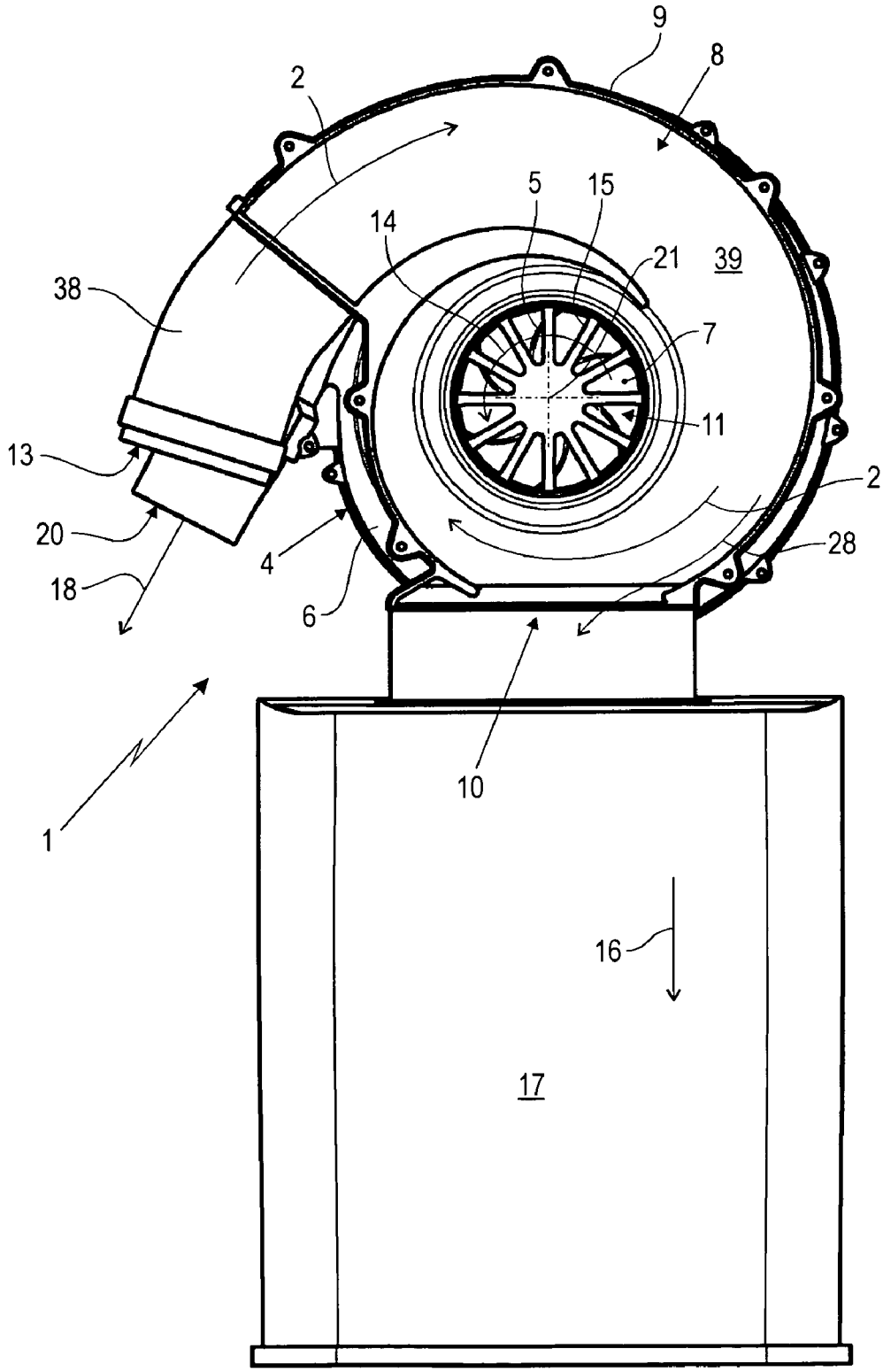
FIG. 2 is an enlarged front view of the suction apparatus of FIG. 1 showing details of the geometrical configuration of the centrifugal separator.

FIG. 2 is a partial plan view of the arrangement of FIG. 1 in the direction of the backpack 22 (FIG. 1), which to facilitate illustration is not shown. The centrifugal separator 8 is shown in an opened view in order to illustrate details of the design of its inner chamber 39.

The centrifugal separator 8 includes an outer peripheral wall 9, which extends about the axis of rotation 21 of the suction fan 4 and narrows, in the direction of the suction air stream, inwardly in a spiral manner with a decreasing radius. A cylindrical configuration of the peripheral wall 9 can also be expedient.

The flow path of the suction air stream 2 in the centrifugal separator 8 begins at an intake opening 13 and, in conformity with the curvature of an upstream intake connector 38 and the peripheral wall 9, extends along a curved path that circulates about the axis of rotation 21, which is disposed perpendicular to the gravitational direction 16 and hence is horizontal. The suction air stream 2 follows the curved path prescribed by the intake connector 38 and the peripheral wall 9, and empties into an intake opening 7 of the suction fan 4; the intake opening 7 is disposed in a central portion 11 of the centrifugal separator 8 and in the illustrated embodiment is disposed centrally relative to the axis of rotation 21. The suction air stream 2 empties centrally into the interior of the fan housing 6 through the intake opening 7. A fan wheel 5, which is driven in the fan housing 6 by the drive motor 3 (FIG. 1), generates a pressure differential that draws in the suction air stream 2 and is blown out as the discharge air stream 18 through a discharge opening 20 of the spiral fan housing 6.

With reference to the gravitational direction 16, the lower portion of the peripheral wall 9 is interrupted, thereby forming a removal opening 10 for the material that is to be sucked up. The removal opening 10 empties into the collection container 17. Although the curved peripheral wall 9 effects a curved path of the suction air stream 2, the centrifugal forces that act upon the sucked-in material carried along in the curved path lead to a concentration of the material in that region of the suction air stream 2 that directly adjoins the peripheral wall 9. The sucked-in material moves along a radially outwardly disposed path, which is indicated by the arrow 28. In the region of the removal opening 10, added to the centrifugal force, which acts radially relative to the axis of rotation 21, is additionally the force of gravity, which acts in the direction of the arrow 16; consequently, the sucked-in material is conveyed along the arrow 28 through the removal opening 10 into the collection container 17. During operation, the collection container 17 is essentially flow-tight; consequently, the suction air stream 2 does not flow through the collection container and in particular does not pass through it into the atmosphere. The separation of the sucked-in material along the arrow 28 and into the collection container 17 is effected essentially entirely due to the forces of gravity that act on the sucked-in material and essentially without the aid of a carrier air stream being conveyed into the collection container 17.

The axes of the suction fan 4 and of the centrifugal separator 8 are disposed parallel to one another, whereby an offset of the axes can be expedient. In the illustrated embodiment, the axes are coaxial to the axis of rotation 21 of the fan wheel 5. A direction of rotation of the fan wheel 5 that results during operation is indicated by the arrow 14. Consequently, the direction of flow of the suction air stream 2, which circulates in a spiral manner about the axis of rotation 21, has an opposite direction and is counter to the direction of rotation 14 of the fan wheel 5. A design having the same direction of rotation can also be advantageous. The fan housing 6 and the intake connector 38 of the centrifugal separator 8 are oriented relative to one another in such a way that the discharge opening 20 of the suction fan 4, and the inlet opening 13 of the centrifugal separator 8, in the view shown here, which is developed in the direction of the axis of rotation 21, are at least approximately aligned with one another. The drawing-in of the suction air stream 2, and the discharge of the discharge air stream 18, are effected on the same side of the suction apparatus 1 and, relative to the gravitational direction 16, are approximately also at the same height.

The diagrammatic illustration of FIG. 2 shows that in the region of the intake opening 7 the fan wheel 5 is covered by a grate 15, the construction and function of which will be described in greater detail subsequently.

Figure 3:
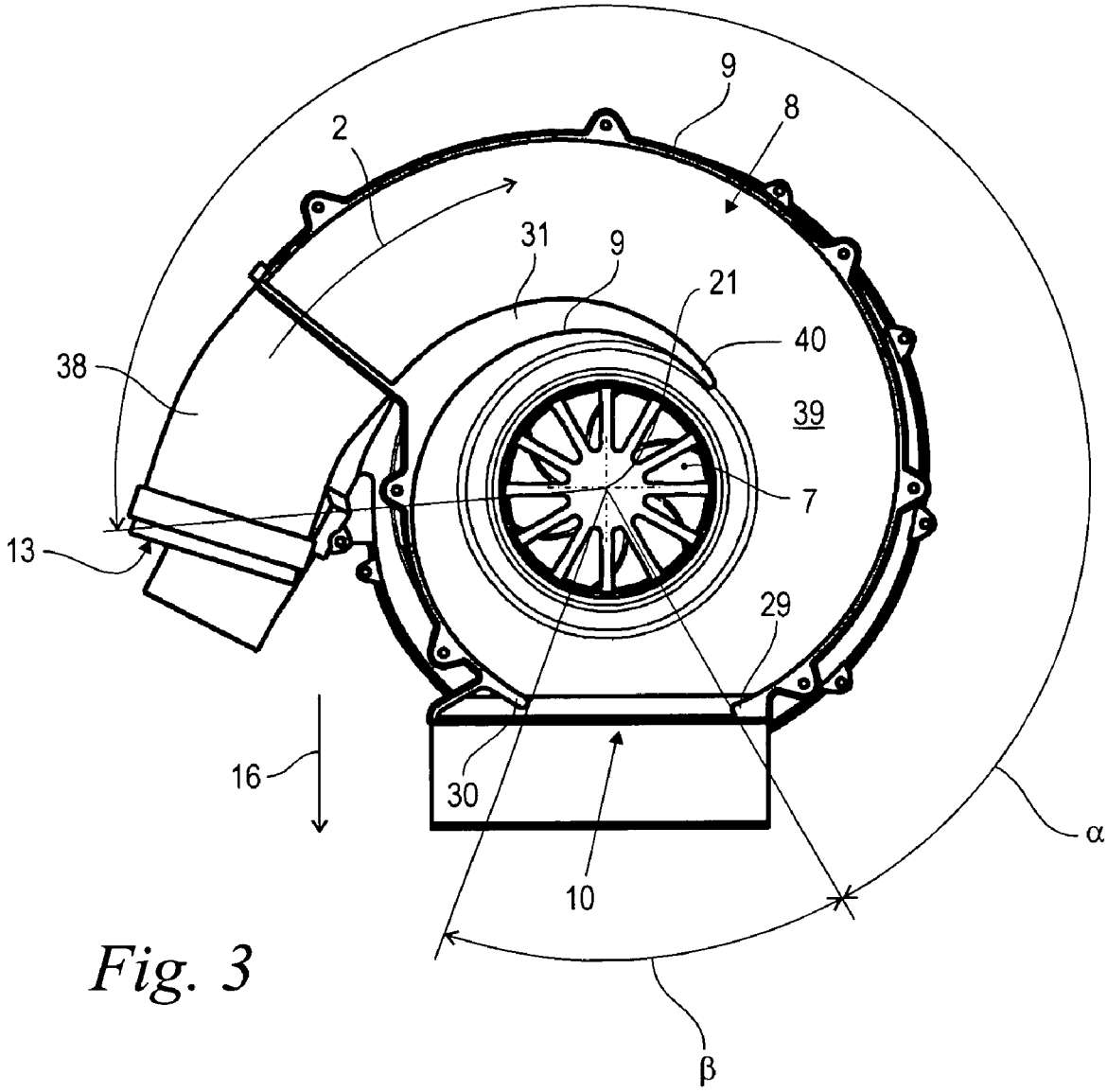
FIG. 3 is an illustration of part of the arrangement of FIG. 2 in the region of the separator showing further details for the configuration of the peripheral wall that narrows in a spiral manner.

FIG. 3 is a detailed view of the arrangement of FIG. 2 in the region of the centrifugal separator 8. The peripheral wall 19 extends in a spiral manner from the inlet opening 13 and in a narrowing manner via the intake connector 38 about the axis of rotation 21 and terminates at an edge 40 of an inwardly disposed wall portion 31. In this connection, the peripheral wall 9 extends over an angle of about 500° before it ends in the immediate vicinity of the intake opening 7.

To form the removal opening 10, and relative to the gravitational direction 16, the peripheral wall 9 is interrupted at the bottom, whereby the removal opening 10 is delimited in the peripheral direction by a first edge 29 and a second edge 30. Relative to the axis of rotation 21, the removal opening 10 extends over an angle $\beta$ in the peripheral direction of about 50°. Between the inlet opening 13 and the first edge 29 of the removal opening 10, the peripheral wall 9, in the direction of flow of the suction air stream 2, extends about a peripheral angle $\alpha$ of preferably from 180 to 270°. In the illustrated embodiment, the angle $\alpha$ is about 250°.

The inlet opening 13 adjoins the peripheral wall 9 in such a way that it, i.e. the suction air stream 2, opens approximately tangentially into the centrifugal separator 8. In conjunction with the diagrammatic illustration of FIG. 4, one can see that the inlet opening 13 and the removal opening 10 are disposed at least approximately in a common plane, which in turn is disposed transverse to the axis of rotation 21 or transverse to the curved peripheral wall 9, and hence corresponds to the drawing plane of FIG. 3. Consequently, the suction air stream 2 has a path that is curved in this plane from the inlet opening 13 to the removal opening 10, without thereby adding any notable axial components. The centrifugal separator 8 hence extends essentially in a radial direction relative to the axis of rotation 21, whereas in the axial direction it is essentially flat, whereby its thickness is prescribed merely by the necessary flow cross-section.

Figure 4:
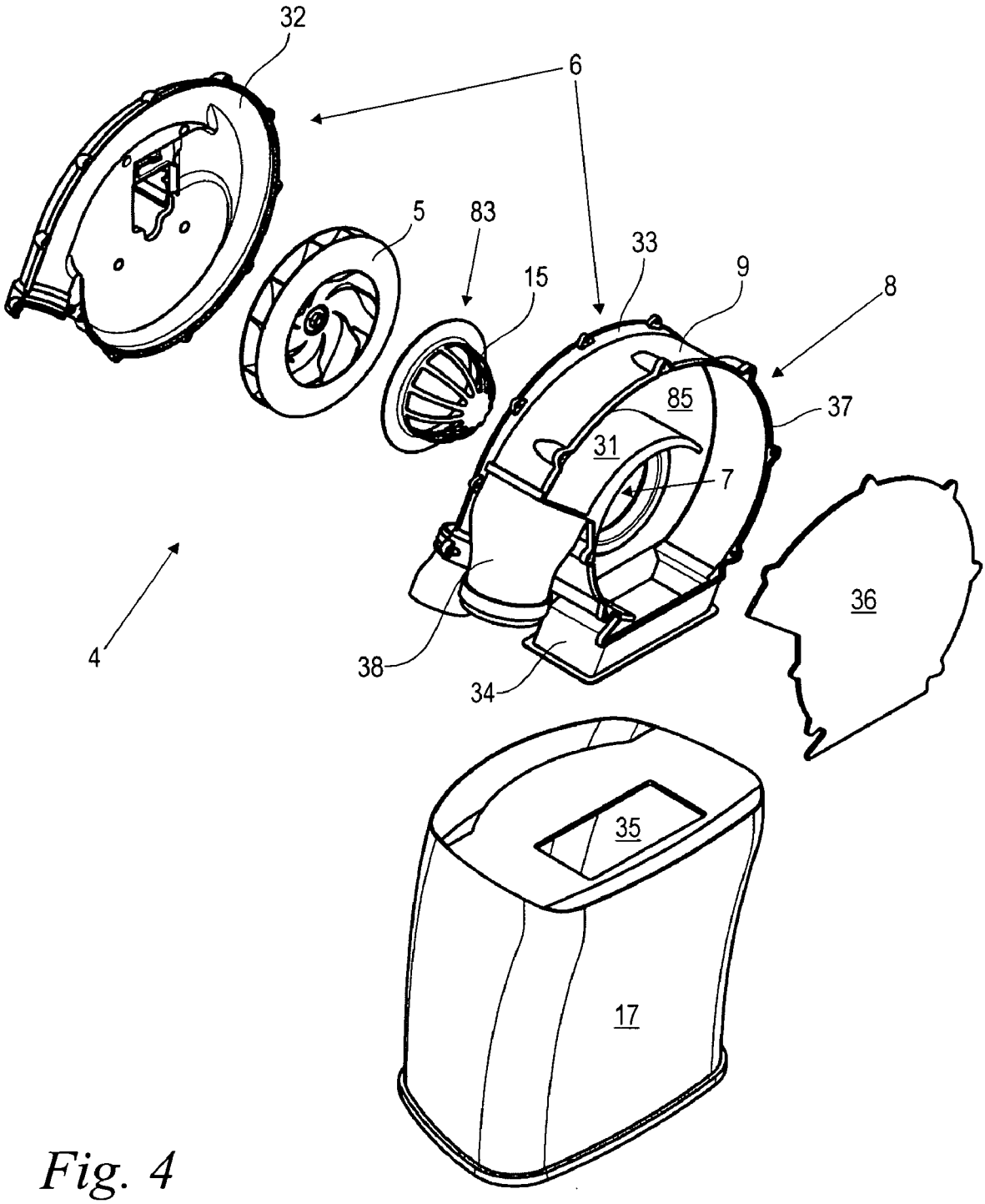
FIG. 4 is a perspective exploded view of the centrifugal separator with the suction fan flanged onto an end face and a collection container disposed on an underside.

FIG. 4 shows an exploded view of the arrangement of FIG. 2, according to which the spiral fan housing 6 is composed of two half shells 32 and 33, between which is rotatably mounted the fan wheel 5 in order to form a radial fan. The half shell 33 of the fan housing 6 that faces the centrifugal separator 8 is monolithically formed on a separator housing 37 of the centrifugal separator 8, and has screw flanges for a screw connection with the other half shell 32. The half shell 33, together with the peripheral wall 9 of the centrifugal separator 8, forms the separator housing 37, which is open on one side in the axial direction, and is closed off in a flow-tight manner by a cover 36 via suitable screw connections. A connector 34 is provided for connecting the separator housing 37 with an opening 35 in the collection container 17, and is monolithically formed on the separator housing 37.

The intake opening 7 is provided with an inlet protector 83 that covers or spans the intake opening 7. In the illustrated embodiment, the inlet protector 83 is a grate 15, which can be flat, conical or the like and in the illustrated embodiment has a hemispherical configuration. The grate 15 is provided for direct securement to the fan wheel 5 of the suction fan 4 so that it rotates therewith, and in the installed state covers the intake opening 7 of the suction fan 4. It can also be expedient to fixedly connect the grate 15 with an end wall 85 of the half shell 33 or fan housing 6 that is provided with the intake opening 7.

The intake connector 38 is also formed on the integral component having the half shell 33 and the separator housing 37, and has a closed cross-section that enables the connection of the suction air hose 25 of FIG. 1. The cover 36 is alone provided for closing off the separator housing 37 in the region disposed downstream of the intake connector 38.

Figure 5:
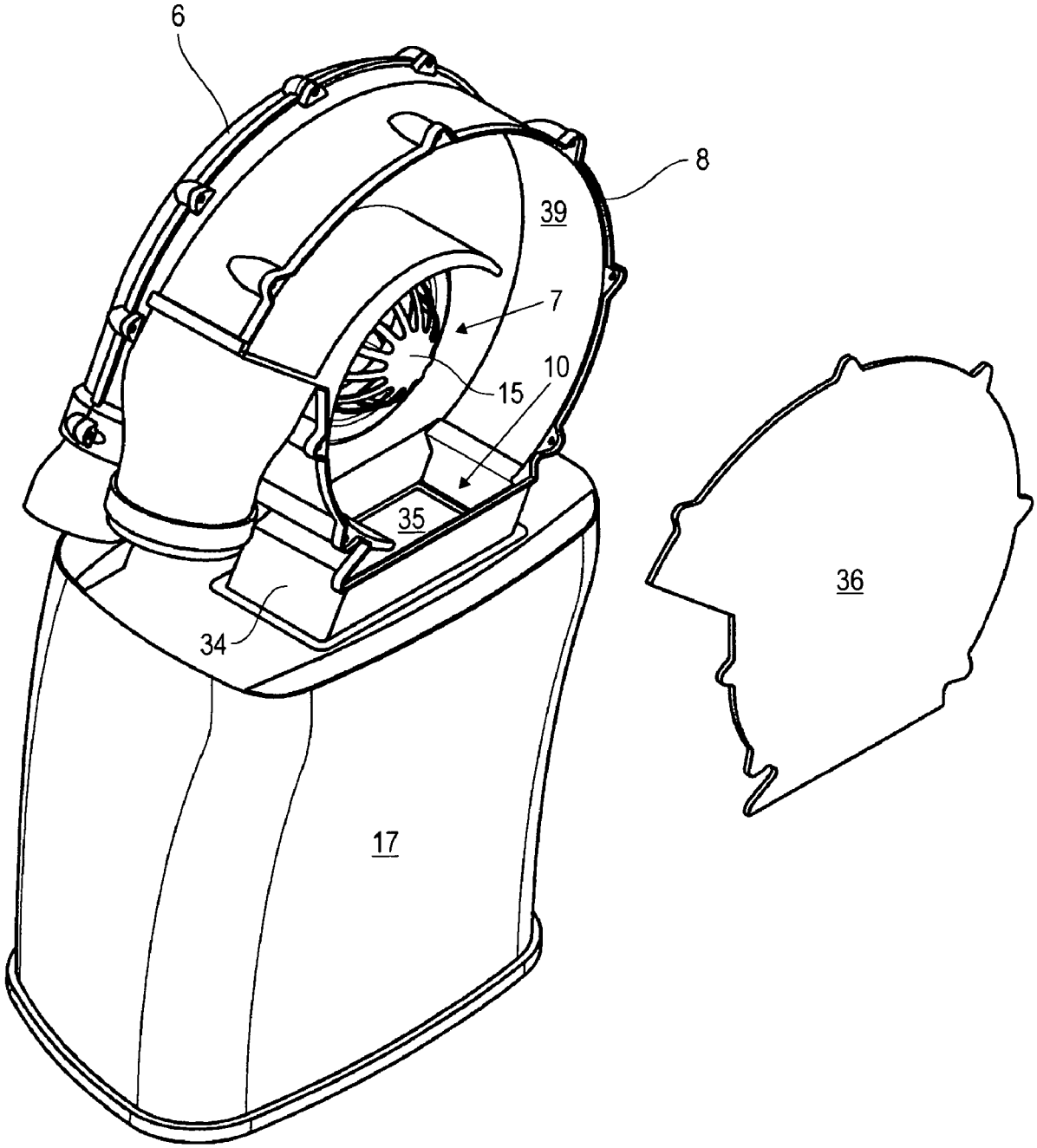
FIG. 5 shows the arrangement of FIG. 4 in the assembled state with the separator cover removed.

FIG. 5 is a perspective view of the arrangement of FIG. 4 in the assembled state, with the cover 36 removed. One can see that the spherical segment shape of the grate 15 covers the central intake opening 7 of the fan housing 6, and in so doing extends into the inner chamber 39 of the centrifugal separator 8.

The connector 34 opens in a sealed manner into the opening 35 of the collection container 17; consequently, the removal opening 10 merges directly into the opening 35.

FIG. 6 shows a perspective, partially cross-sectioned view of a further embodiment of the section apparatus 1 having the fan housing 6 and the centrifugal separator 8. The fan housing 6 adjoins the centrifugal separator 8 via an end wall 85, whereby the intake opening 7 is disposed in the end wall 85.

Departing from the embodiment of FIGS. 1 to 5, instead of the grate 15 shown there here an inlet protector 83 is provided that has a hub 86 with impact paddles 84. The hub 86 is disposed coaxially relative to the fan wheel 5 and is connected so as to rotate therewith. The hub 86 is guided through the intake opening 7 and into the inner chamber 39 of the centrifugal separator 8. A total of three impact paddles 84, which are uniformly distributed in the peripheral direction, extend in a radial direction from the hub 86. A different number of impact paddles 84 can also be expedient. The inlet protector 83 projects into the inner chamber 39 of the centrifugal separator 8 in such a way that the impact paddles circulate in the inner chamber. In this connection, the impact paddles 84 extend over the intake opening 7 in an oversized manner in such a way that in addition to the intake opening 7, they also extend over an edge region of the end wall 85 of the fan housing 6 that includes the intake opening 7. In the axial direction, the impact paddles 84 rest against the end wall 85 in a manner that is nearly free of play, so that in the effective range of the impact paddles 84, they clear the end wall 85 of any deposits that form.

In addition, an air channel 89 branches off from the peripheral side of the fan housing 6 and opens into a cyclone 90. Fine dust or the like, which was not removed from the suction air stream by the centrifugal separator 8, is introduced via a carrier air stream through the air channel 89 into the cyclone 90, where it is removed and conveyed via a dust channel 88 into the collection container 17. The carrier air stream is withdrawn from the cyclone 90 via a conduit 87.

The remaining features and reference numerals of the embodiment of FIG. 6 coincide with those of FIGS. 1 to 5.

The embodiment shown in FIGS. 1 to 6 combines a number of inventive features that in the combination shown here complement one another. However, it can also be expedient to provide a suction apparatus in which individual features are embodied independently of one another. For example, the spiral shape of the centrifugal separator can also extend in the same direction as the direction of rotation of the fan wheel. Similarly, it can be advantageous to use the opposite direction arrangement with a construction that differs from the spiral shape, for example a cylindrical construction. In addition to the preferred embodiment shown here having a closed air system according to FIG. 1, a suction apparatus can also be expedient where the discharge air stream is not conveyed to a suction nozzle, but rather into the atmosphere.

Figure 7:
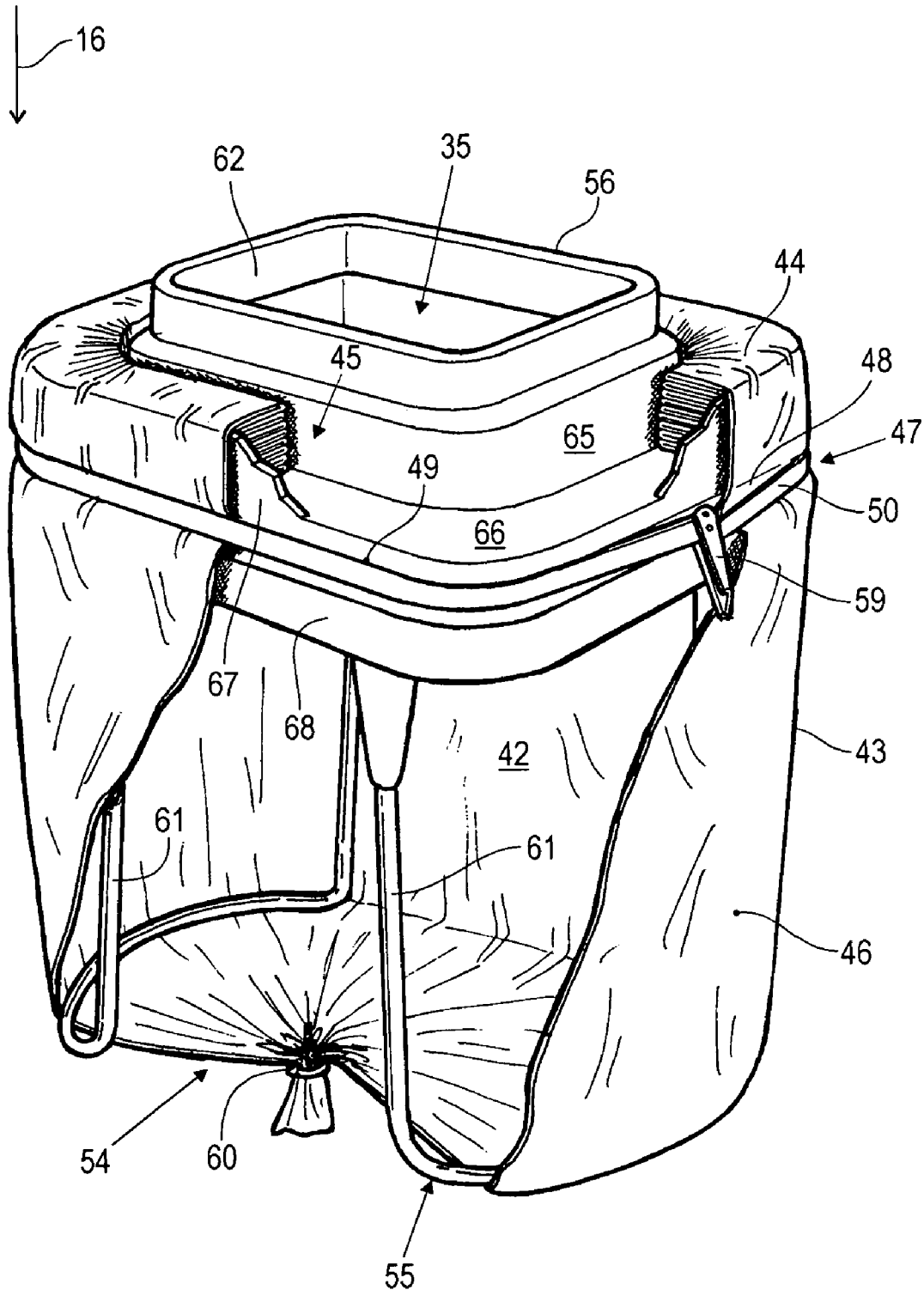
FIG. 7 is a partially sectioned perspective view of an assembly unit that can be detached from the rest of the section apparatus and that is provided with a holder and an endless tube that is held thereon by a strap and that is supported on the inside in the region of the collection bag by curved pieces.

FIG. 7 is a perspective view of an assembly unit that, instead of the collection container 17 of FIG. 1, can be connected to the centrifugal separator 8 shown there. The assembly unit forms an essentially flow-tight construction of a collection device for the material that is sucked up, and includes a holder 56 and an endless tube 43 that is made of an air tight, liquid tight and odor proof film of polymeric material. The holder 56 is provided with an annular collar 62 that surrounds the opening 35. In the installed state, the collar 62 of the holder 56 directly adjoins the peripheral wall 9 of the centrifugal separator 8 (FIG. 1) in a flow-tight manner and in such a way that the removal opening 10 merges directly into the opening 35.

In the gravitional direction 16, adjoining below the collar 62, and having a larger radial spacing, is an inner peripheral wall 65 of an annular storage chamber 45, which has a U-shaped cross-section and is open upwardly. The storage chamber 45 is delimited at the bottom by a base 66, which extends annularly about the inner peripheral wall 65, and is delimited outwardly by an outer peripheral wall 67. A shoulder 68 extends below the storage chamber 45 with an enlarged radial spacing. The aforementioned parts monolithically form the holder 56, which is made of injection molded polymeric material.

The endless tube 43 is monolithically provided with a supply portion 44, a container portion 46, and between them an annularly extending clamped portion 48. The selected designation of the endless tube 43 here means that its originally provided total length is significantly greater than is necessary for producing an individual collection bag 42, and suffices for the formation of a plurality of collection bags. The annularly extending cross-section of the supply portion 44 of the endless tube 43 is folded up in a zigzagged manner and is stored in the storage chamber 45 of the holder 56. Proceeding from the supply portion 44, the endless tube 43 is first guided upwardly and is then folded downwardly about the upper edge of the outer peripheral wall 67. From there, extending outwardly along the outer side of the outer peripheral wall 67, as well as along the outer side of the shoulder 68, it is guided downwardly.

The outer side of the outer peripheral wall 67, which adjoins the outwardly projecting shoulder 68, forms an annular abutment surface 49 against the outer side of which the clamped portion 48 of the endless tube 43 rests in an annular manner. The clamped portion 48 is surrounded by a clamping band or strap 50 having a clamping lever 59, which in the illustrated arrangement extends outwardly at an angle, as a result of which the strap is loosened. After folding the clamping lever 59 in parallel to the abutment surface 49, the strap 50 is tightened, as a result of which it presses the clamped portion 48 of the endless tube 43 in a radial direction against the abutment surface 49 in a clamped and sealed manner. This prevents the endless tube 43 from sliding through in the gravitational direction 16.

The container portion 46 of the endless tube 43 adjoins the bottom side of the clamped portion 48. The lower end 54 of the container portion 46 is pinched off by means of a filament or similar tie 60, and hence is sealingly closed off. In conjunction with the flow-tight, clamping resting against the abutment surface 49, and the flow-tight transition of the collar 62 at the periphery of the removal opening 10 (FIG. 1), an overall flow-tight, closed off collection bag 42 is formed by the container portion 46 of the endless tube 43. The collection bag 42 is suspended essentially freely below the holder 56 and, by means of the tensile stress that results in the material of the container portion 46, supports the weight of the suctioned material that is to fill the collection bag 42. The weight is absorbed by the clamping of the clamped portion 48 against the abutment surface 49, as a result of which a weight support 47 is formed for the collection bag 42, and the suctioned material accommodated therein. The weight support 47 prevents the supply portion 44, which is monolithically connected with the container portion 46, from pulling out of the storage chamber 45 due to the weight.

The upper region of the collection bag 42 is expanded by the peripheral shoulder 68 to such an extent that a correspondingly large receiving volume is provided in the interior of the collection bag 42 regardless of how full it is. The desired collection volume can be obtained, after loosening the strap 50, by pulling the container portion 46 out of the storage chamber 45 to the desired extent, thereby using up some of the supply portion 44; the container portion 46 is then closed off by the filament 60. After the desired length of container portion 46 has been obtained, the clamping lever 59 is tightened, thereby clamping the clamped portion 48 by means of the strap 50.

In addition to the cross-sectional support of the collection bag 42 by means of the peripheral shoulder 68, a shape-imparting support structure 55 is provided that is disposed on the inside of the collection bag 42. In the illustrated embodiment, the support structure 55 includes two curved pieces 61 that are bent in an approximately U-shaped manner and are secured to the underside of the holder 56, from which they extend downwardly in an essentially vertical direction; in the region of the lower end 54 of the collection bag 42, the curved pieces 61 are bent radially outwardly. In the illustrated embodiment, the endless tube 43 is guided about the two curved pieces 61 in a nearly taut manner, whereby the lower end 54 of the collection bag 42 forms an approximately planar bottom. It can also be expedient to withdraw the endless tube 43 further downwardly, whereby the support effect of the support structure 55 is then limited to only the upper portion of the collection bag 42. During operation of the suction apparatus 1 illustrated in FIGS. 1 and 2, a slight underpressure can result in the interior of the collection bag 42. The support structure 55 prevents a pulling together of the collection bag 42 as a result of the underpressure, thereby ensuring an adequately large collection volume of the bag 42.

After the collection bag 42 is filled, the strap 50 is loosened and the filled collection bag is withdrawn downwardly, whereby the supply portion 44 is pulled downwardly below the strap 50. The filled portion of the endless tube 43 is then clamped off above the filled material, is tied or otherwise closed off, and is removed. A hermetically closed off collection bag 42 results that is clamped off at both ends and that contains the collected sucked-up material in a sealed manner. The endless tube 43 that was previously withdrawn from the storage chamber 45 is pulled around the support structure 55 in conformity with the illustration of FIG. 3, and is again closed off with the filament 60 to form an empty collection bag 42. Instead of closing off the bag with the filament 60 that is shown, the lower end 54 of the collection bag 42 can be closed off by a knot, fusing, tying off, or the like. A separation or removal of the filled collection bag 42 can be effected with a sharp knife, with scissors or also thermally using the aforementioned fusing device. The upper side of the filled collection bag 42 is closed off in the same manner.

Figure 8:
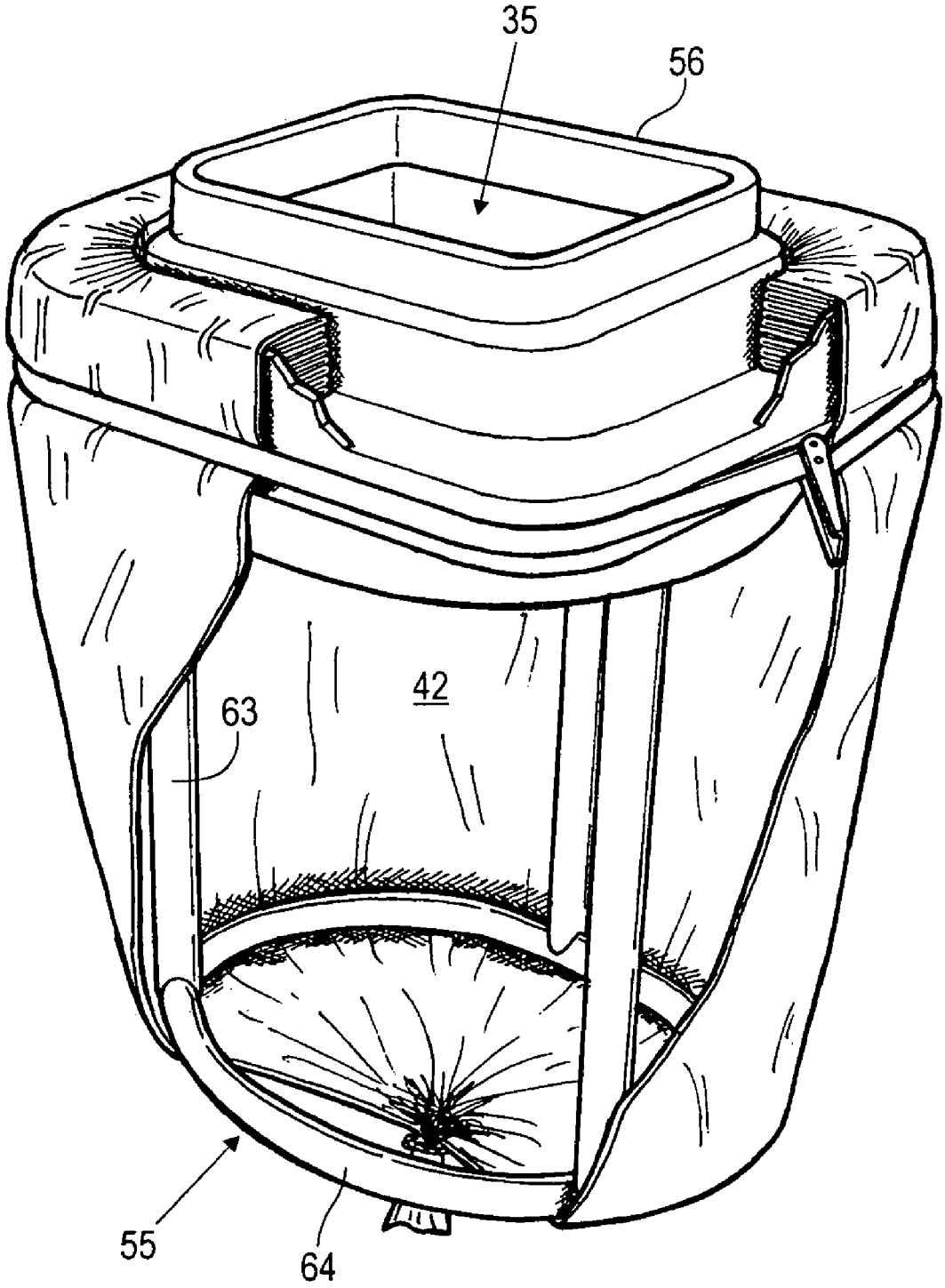
FIG. 8 is a variant of the arrangement of FIG. 7 with a shape-imparting support on the inside via struts and a ring.

FIG. 8 shows a variant of the arrangement of FIG. 7. In this case, the support structure 55 is formed by a total of three struts 63 that extend vertically downwardly from the holder 56 and support a ring 64 at their lower ends. The support structure 55, which is disposed within the collection bag 42 and is composed of the struts 63 and the ring 64, together with the holder 56 holds the collection bag 42, as is also the case with the embodiment of FIG. 7, in a shape such that a spread-apart interior of the collection bag 42 is made available even without sucked-up material disposed therein. The remaining features of the embodiment of FIG. 8 coincide with those of FIG. 7.

Figure 9:
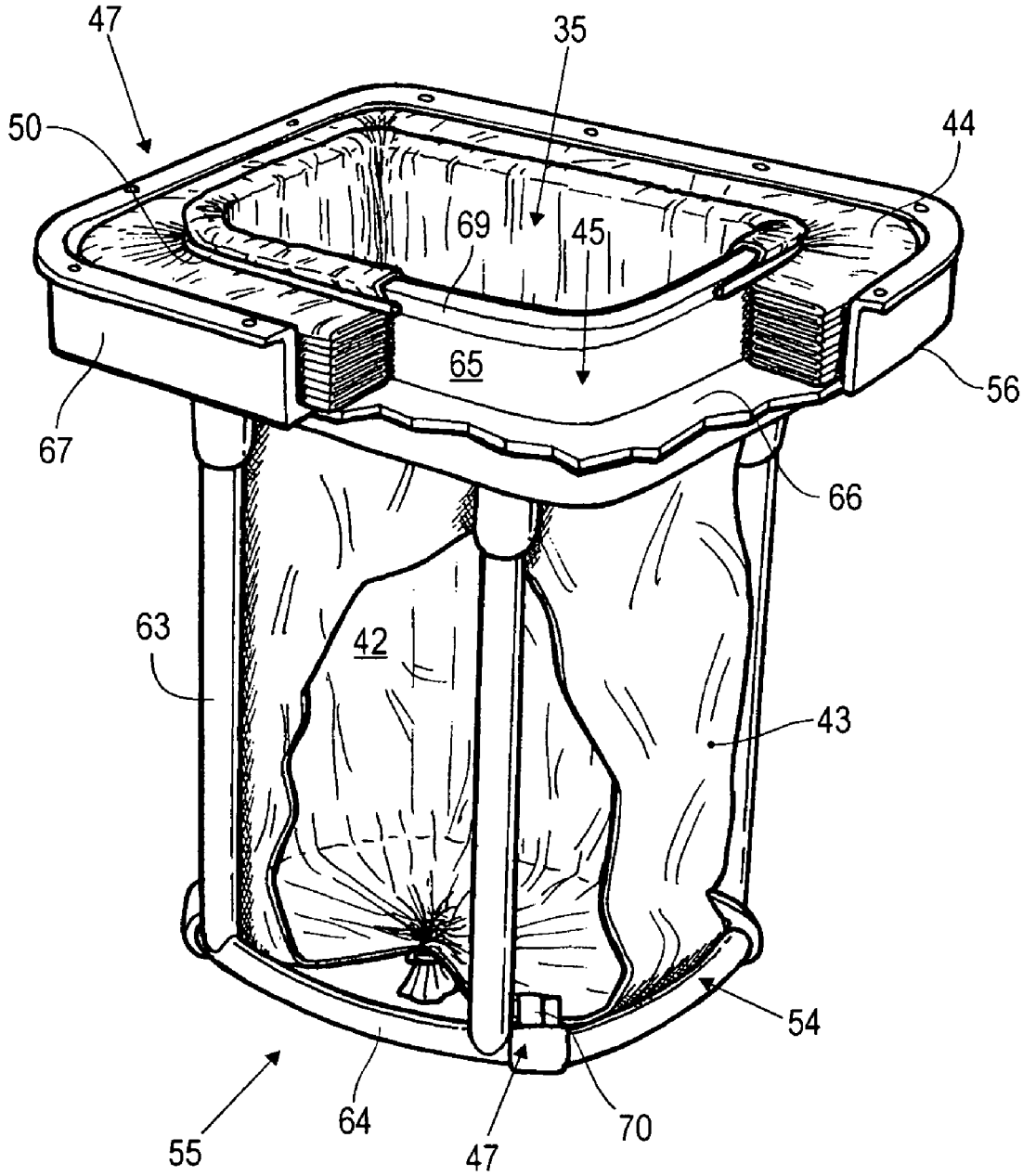
FIG. 9 is an embodiment of the collection bag having a shape-imparting support on the outside via struts and a ring.

FIG. 9 provides a variant of the assembly unit formed of the holder 56 and the endless tube 43. Here, the endless tube 43, proceeding from the supply portion 44, is guided about an inner, upper edge of the inner peripheral wall 65 and is pulled toward the inside and down through the opening 35. The shape-imparting support structure 55, which is composed of a total of four struts 63 and the ring 64, is here disposed on the outer side of the collection bag 42.

A total of two weight supports 47 are provided for the collection bag 42. A first weight support 47 is formed in the region of the inner peripheral wall 65. Formed above the inner peripheral wall 65 is a flange 69 that projects radially outwardly at an angle. The clamping band 50 is here guided around on the outside in the transition region from the inner peripheral wall 65 and the flange 69, and fixedly clamps the endless tube 43 on the outer side of the inner peripheral wall 65.

To form a second weight support 47, and also as part of the support structure 55, provided at the four corner regions of the ring 64, which is rounded in a nearly square or rectangular manner, are a total of four clamps 70 in which the film material of the lower end 54 of the collection bag 42 is clamped. In this connection, the clamps 70 hold the lower end 54 in a radially outward direction, thereby aiding an expansion of a cross-sectional shape of the collection bag 42 in the region of the lower end 54. Furthermore, the clamps 70 are also in the position to absorb a portion of the weight applied by the filled material. The remaining features and reference numerals of the embodiment illustrated here coincide with those of FIGS. 7 and 8.

Figure 10:
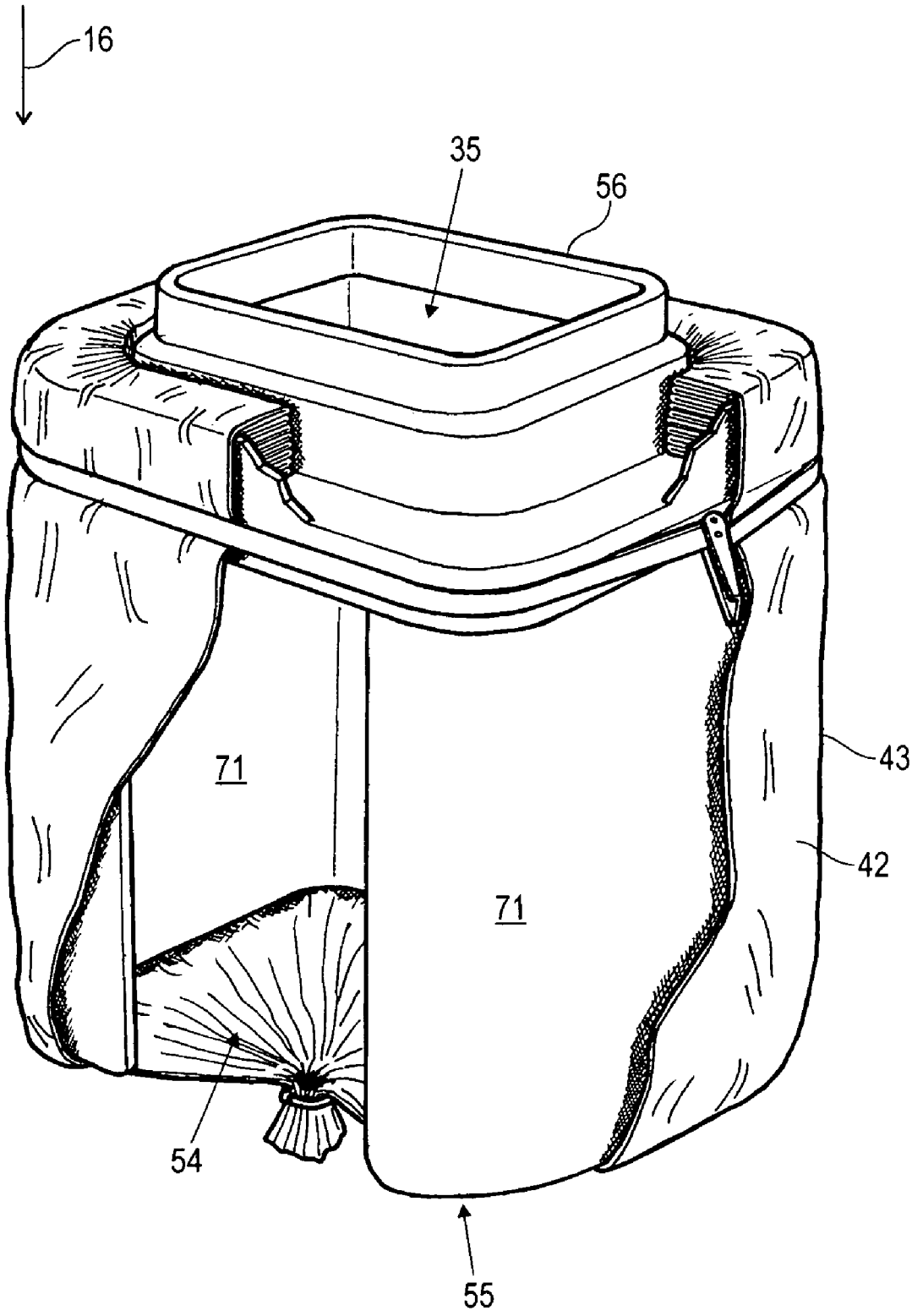
FIG. 10 is a further embodiment of the collection bag having a shape-imparting support on the inside via half shells.

FIG. 10 shows a further embodiment of the assembly unit composed of the holder 56 and the endless tube 43. Here, provided on the underside of the holder 56 are two half shells 71 that extend in the gravitational direction 16 and form the support structure 55 for the collection bag 42. The two half shells 71 are monolithically formed on the holder 56 and are spaced apart in the lateral direction. Furthermore, the half shells 71 are open in a downward direction; therefore, a bottom of the collection bag 42 is formed by the bound-together lower end 54 of the bag. The remaining features of the embodiment of FIG. 10 coincide with those of FIG. 7.

Figure 11:
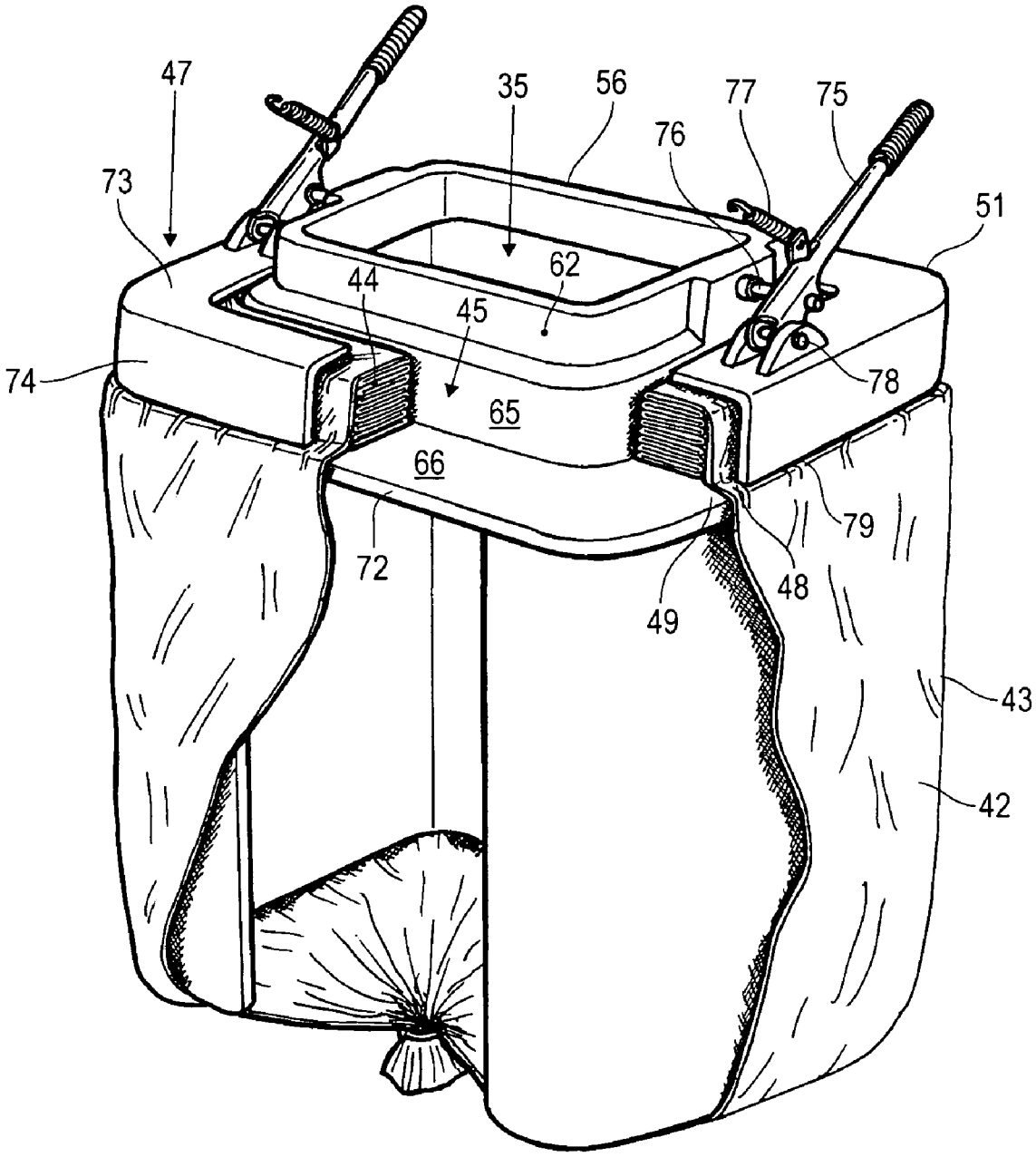
FIG. 11 is a variant of the arrangement of FIG. 10 having a weight support provided by a frame-shaped clamping member.

FIG. 11 shows a variant of the arrangement of FIG. 10. In this case, a weight support 47 is formed by a clamping member 51 that cooperates with the holder 56. The storage chamber 45 of the holder 56 is formed by the inner peripheral wall 65 and the peripheral base 66 that adjoins it at the bottom and on the outer side, whereby the base 66 extends radially outwardly into a free peripheral edge 72. The peripheral cross-section of the clamping member 51 has an approximately L-shaped configuration. and comprises an upper, approximately horizontally extending annular surface 73, which is adjoined at the outside and toward the bottom by a peripheral, outer annular wall 74. The clamping member 51 surrounds the pile of the supply portion 44, which is folded in a zigzagged manner, and holds it together.

A respective lever 75 is disposed on two opposite ends of the collar 62, whereby the two levers 75 are pivotably mounted on the collar 62 about the pivot axes 76. Engaging each lever 75 in the direction of the free end thereof is a tension spring 77 that in the installed state of the assembly unit shown here is secured to a further component of the suction apparatus 1 (FIG. 1). The opposite end of the lever 75, relative to the tension spring 77, is mounted on the upper annular surface 73 of the clamping member 51 by means of a joint 78. The tension force of the spring 77 pivots the lever 75 in such a way that the clamping member 51, at the joint 78, is pressed downwardly against the supply portion 44 and presses the latter together.

In this connection, a lower edge 79 of the clamping member 51 presses the clamped portion 48 of the endless tube 43 against the base 66 that hereby, in performing a double function, also forms an abutment surface 49 for the clamped portion 48. A weight support 47 for the collection bag 42 is thereby formed. The remaining features of the embodiment of FIG. 11 correspond with those of FIG. 10.

Figure 12:
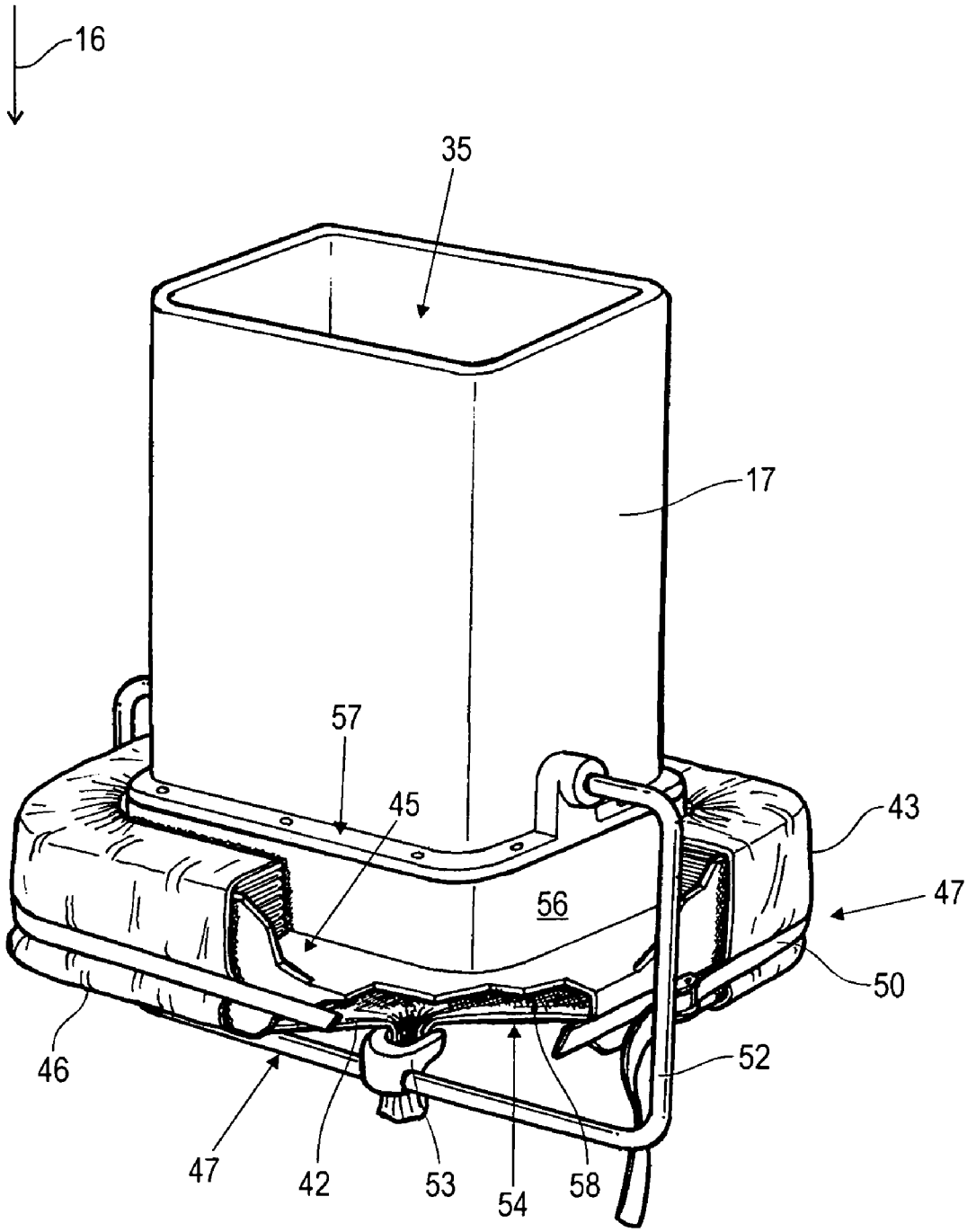
FIG. 12 shows an inherently stable collection container having a collection bag mounted on the bottom and formed from an endless tube.

FIG. 12 shows an embodiment of the exchangeable assembly unit that in addition to the holder 56 and the endless tube 43 also shows a collection container 17 that is essentially inherently stable. The collection container 17 is open in an upward direction to form the opening 35, while the holder 56 is disposed on the underside of the container. It can be expedient to provide the container 17 with a detachable, inherently stable bottom 58, in conformity with the illustration of FIG. 1, in order to empty the sucked-up material that has collected therein into the collection bag 42 after the container 17 is filled. In the illustrated embodiment, the collection container 17 has an approximately tubular shape, and is also open toward the bottom. The collection container 17 is sealed off toward the bottom by the closed end 54 of the collection bag 42. In this way, a bottom 58 of the collection container 17 is formed.

In conformity with the illustration of FIG. 7, the holder 56 has an annular storage chamber 45 for the endless tube 43 and, at a lower side 57 that is opposite the opening 35 or the associated removal opening 10 (FIG. 2), extends about the collection container 17 in an annular manner. It can be expedient, in conformity with the illustration of FIG. 7, to withdraw the container portion 46 further downwardly and to thereby form a larger collection bag 42. In the illustrated embodiment, the container portion 46 is guided directly inwardly to form the lower end 54, whereby the collection bag 42 is reduced to the bottom 58.

Disposed below the collection container 17 and the collection bag 42, in the gravitational direction 16, is a support bracket 52 that is pivotably secured to side surfaces of the collection container 17 and extends transversely below the illustrated arrangement. In the middle, the support bracket 52 is provided with a clamp 53 by means of which the lower end 54 of the endless tube 43 is detachably closed off to form the collection bag 42. At the same time, the collection bag 42 rests upon the support bracket 52. In addition to the weight support 47 having the strap 50 in conformity with the illustration of FIG. 7, the support bracket 52 forms an additional weight support 47.

After the collection container 17 is full, the collection bag 42 can be closed off above the clamp 53 in the manner previously described and can be removed from the clamp 53. Subsequently, after loosening of the two weight supports 47, the collection bag 42 can be withdrawn downwardly until the sucked-up material that is located in the collection container 17 is accommodated in the collection bag 42. In this state, the collection bag 42 can first be temporarily closed off by the clamp 53 before a subsequent closing-off of the upper side is effected in conformity with the closing off of the lower end 54. This subsequent closing is expediently undertaken below the clamp 53, as a result of which in a single operation at the same time also the new collection bag 42 is closed off at its lower end 54 by means of the clamp 53 in an operationally ready manner.

The specification incorporates by reference the disclosure of German priority document 10 2005 053 632.8 filed Nov. 10, 2005.

The present invention is, of course, in no way restricted to the specific disclosure of the specification and drawings, but also encompasses any modifications within the scope of the appended claims.

What we claim is:

1. A manually guided suction apparatus, for suctioning up material via a suction air stream, comprising:

a suction fan that is driven by a drive motor, wherein said suction fan includes a fan wheel and a fan housing that surrounds said fan wheel, and wherein said fan housing is provided with an intake opening;

a centrifugal separator that is disposed upstream of said intake opening and is adapted to produce a curved path of said suction air stream, wherein said centrifugal separator has a curved peripheral wall in which is disposed a removal opening for material that is adapted to be sucked up, and wherein said intake opening is disposed approximately in a central portion of said centrifugal separator; and an inlet protector for said intake opening of said suction fan, wherein said inlet protector extends into an inner chamber of said centrifugal separator.

2. A manually guided suction apparatus, for suctioning up material via a suction air stream, comprising:

a suction fan that is driven by a drive motor, wherein said suction fan includes a fan wheel and a fan housing that surrounds said fan wheel, and wherein said fan housing is provided with an intake opening;

a centrifugal separator that is disposed upstream of said intake opening and is adapted to produce a curved path of said suction air stream, wherein said centrifugal separator has a curved peripheral wall in which is disposed a removal opening for material that is adapted to be sucked up, and wherein said intake opening is disposed approximately in a central portion of said centrifugal separator; and an inlet protector for said intake opening of said suction fan, wherein said inlet protector is connected to said fan wheel so as to rotate therewith.

3. A suction apparatus according to claim 2, wherein said peripheral wall of said centrifugal separator follows a path that in a direction of flow of said suction air stream narrows in a spiral manner.

4. A suction apparatus according to claim 2, wherein said centrifugal separator has an inlet opening that is disposed in the region of said peripheral wall and preferably opens tangentially into said centrifugal separator.

5. A suction apparatus according to claim 4, wherein said inlet opening and said removal opening are disposed in a common plane that extends transverse to said peripheral wall.

6. A suction apparatus according to claim 2, wherein said peripheral wall extends between an inlet opening of said centrifugal separator and said removal opening about a peripheral angle ($\alpha$) of from 180 to 270° in a direction of flow of said suction air stream.

7. A suction apparatus according to claim 2, wherein in a customary operating position of the suction apparatus, said removal opening faces downwardly as viewed in a gravitational direction.

8. A suction apparatus according to claim 2, wherein said suction fan is a radial fan, and wherein axes of said radial fan and of said centrifugal separator are disposed parallel to one another.

9. A suction apparatus according to claim 8, wherein a direction of flow of said suction air stream in said centrifugal separator is opposite to a direction of rotation of said fan wheel.

10. A suction apparatus according to claim 9, wherein a discharge opening of said radial fan is approximately in alignment with an inlet opening of said centrifugal separator.

11. A suction apparatus according to claim 2, wherein said inlet protector extends over said intake opening.

12. A suction apparatus according to claim 2, wherein said inlet protector is embodied as a grate.

13. A suction apparatus according to claim 12, wherein said grate has a hemispherical configuration.

14. A suction apparatus according to claim 2, wherein said inlet protector is provided with radially extending impact paddles that in particular in an inner chamber of said centrifugal separator extend over an edge region of an end wall of said fan housing that includes said intake opening.

15. A manually guided suction apparatus for suctioning up material via a suction air stream, comprising, a suction fan that is driven by a drive motor, wherein said suction fan includes a fan wheel and a fan housing that surrounds said fan wheel, and wherein said fan housing is provided with an intake opening;

a centrifugal separator that is disposed upstream of said intake opening and is adapted to produce a curved path of said suction air stream, wherein said centrifugal separator has a curved peripheral wall in which is disposed a removal opening for material that is adapted to be sucked up, wherein said intake opening is disposed approximately in a central portion of said centrifugal separator, wherein said suction air stream is adapted to be guided past said removal opening, and wherein said removal opening is adapted to empty into an essentially flow-tight collection device;

a storage chamber, wherein said collection device includes a collection bag that is adapted to be closed off in an essentially flow-tight manner; and an endless tube that is adapted to be folded up to form a supply portion that is adapted to be stored in said storage chamber, wherein proceeding from said storage chamber, a container portion of said endless tube forms said collection bag.

16. A suction apparatus according to claim 15, wherein a weight support for said collection bag is provided that is adapted to prevent said supply portion from being pulled out of said storage chamber.

17. A suction apparatus according to claim 15, wherein a shape-imparting support structure is provided for said collection bag, and wherein said support structure is in particular disposed on an inner side of said collection bag.

18. A manually guided suction apparatus for suctioning up material via a suction air stream, comprising:

a suction fan that is driven by a drive motor, wherein said suction fan includes a fan wheel and a fan housing that surrounds said fan wheel, and wherein said fan housing is provided with an intake opening;

a centrifugal separator that is disposed upstream of said intake opening and is adapted to produce a curved path of said suction air stream, wherein said centrifugal separator has a curved peripheral wall in which is disposed a removal opening for material that is adapted to be sucked up, and wherein said intake opening is disposed approximately in a central portion of said centrifugal separator; and a suction nozzle that is adapted to guide said suction air stream, wherein a discharge air stream that is produced by said suction fan is adapted to be conveyed to said suction nozzle.

19. A suction apparatus according to claim 18, which includes a discharge air hose that conveys said discharge air stream, wherein said discharge air hose is configured to discharge said discharge air stream at said suction nozzle so as to whirl material that is to be suctioned up.

* * * * *